US006668473B2

(12) United States Patent
Schoening

(10) Patent No.: US 6,668,473 B2
(45) Date of Patent: Dec. 30, 2003

(54) DEVICE FOR SUSPENDING POSTERS

(75) Inventor: Michael Schoening, Heinsberg (DE)

(73) Assignee: Distec GmbH, Heinsberg (DE)

( * ) Notice: Subject to any disclaimer, the term of this patent is extended or adjusted under 35 U.S.C. 154(b) by 147 days.

(21) Appl. No.: 09/772,473

(22) Filed: Jan. 30, 2001

(65) Prior Publication Data

US 2001/0010133 A1 Aug. 2, 2001

(30) Foreign Application Priority Data

| | | |
|---|---|---|
| Feb. 2, 2000 | (DE) | 100 04 566 |
| Jun. 24, 2000 | (EP) | 00113426 |
| Jul. 22, 2000 | (EP) | 00115826 |

(51) Int. Cl.[7] ..... G09F 11/18; B65H 18/08

(52) U.S. Cl. ..... 40/518; 40/471; 242/538.2; 242/548.2; 242/615.3

(58) Field of Search ..... 40/471, 518; 242/538.2, 242/538.3, 548.2, 566, 615.3; 226/196.1

(56) References Cited

U.S. PATENT DOCUMENTS

| | | | | |
|---|---|---|---|---|
| 3,850,358 A | * | 11/1974 | Nettles | 242/615.11 |
| 3,902,648 A | * | 9/1975 | Keyser | 242/615.2 |
| 3,915,449 A | * | 10/1975 | Johnson et al. | 271/251 |
| 3,927,814 A | * | 12/1975 | Holm | 242/615.2 |
| 4,316,664 A | * | 2/1982 | Nishimoto | 396/620 |
| 4,348,125 A | * | 9/1982 | Fujiwara et al. | 400/645.1 |

FOREIGN PATENT DOCUMENTS

| | | |
|---|---|---|
| DE | 2 112 786 | 9/1972 |
| DE | 295 10 670 | 7/1995 |
| EP | 0 931 965 | 7/1999 |
| FR | 9912424 | 9/1999 |
| GB | 2 183 776 | 6/1987 |

* cited by examiner

*Primary Examiner*—Brian K. Green
(74) *Attorney, Agent, or Firm*—Collard & Roe, P.C.

(57) ABSTRACT

A device for suspending posters comprises a poster web that can be driven back and forth between two rolls with longitudinal tensioning in the direction of transport. The rolls are arranged one on top of the other. Each of the lateral longitudinal edges of the web extend in the transport direction. To avoid annoying fluttering of the poster web in wind and weather, a holding device is associated as a lateral guide for the web between the rolls.

10 Claims, 2 Drawing Sheets

DEVICE FOR SUSPENDING POSTERS

BACKGROUND OF THE INVENTION

1. Field of the Invention

The invention relates to a device for suspending posters, comprising a web of posters which can be driven back and forth between two rolls or rollers arranged spaced from each other one on top of the other. The web of posters is longitudinally tensioned in the direction of transport. There are holders that serve as lateral guides of the web that substantially reach from one roll to the other. These holders are associated with the reinforced longitudinal edges of the web of posters between the rolls.

The web of posters is generally moved back and forth vertically. However, the invention is not limited to the vertical direction of transport. The picture or poster displayed between the rolls may be inclined against the vertical or the movement of the picture may take place horizontally as well. Thus, even though only a vertical direction of transport is explained or claimed here and in the following, deviations from the vertical are included as well.

The device for suspending posters is suitable for displaying a poster in its total size. Preferably, two or more individual poster pictures can be assembled, for example by gluing, fusing or stapling them together, or with the help of some type of zipper, so that a web of posters is obtained. This web of posters is wound from one roll to the other in sections so as to permit recognition of the individual poster picture.

2. The Prior Art

If such a device for suspending posters is set up outdoors, the entire arrangement is usually surrounded by a showcase having a window made of glass or plastic on the viewing side. An advertising showcase of this type is described, for example in German Patent No. DE 29 51 0670 U1. If the viewing surface to be displayed exceeds a certain size, for example 3 by 4 meters, it is difficult to produce the transparent front glass pane and to transport it to the site of erection. For that reason, it has been proposed to assemble the front glass pane from a number of components. However, this is still expensive.

Poster materials are available which are weatherproof to such a degree that a front pane of the advertising showcase would not be needed even if such a showcase is set up outdoors. Generally, materials that are insensitive to moisture, such as plastic, textiles, coated paper or metal foil materials can be used for the web. Good results were obtained in practical applications with webs of vinyl. However, in practice, the front pane has nonetheless been required because the web of posters is exposed not only to sunlight and rain but also to wind or storm conditions. Even draft air in a hall may cause the web of posters clamped between the rolls to flutter if the front pane of the showcase is missing.

French patent application 99 12 424 describes a device for suspending posters of the type specified above. The device has an upper roll and a lower roll. A web of posters is wound back and forth between the rolls with the web in a longitudinally tensioned condition. In addition, the device comprises means for applying tension to the web of posters crosswise, the objective being that the web of posters will be capable of withstanding stress caused by wind gusts as well as other weather influences, and that it can be wound up uniformly without throwing folds.

As a means for applying the transverse tension, the French patent application proposes to equip the lateral longitudinal edges of the poster web with edge reinforcements, so-called welts, and to associate frame components each having a groove extending from roll to roll with the reinforced edges. The grooves extend across their entire length over the reinforced edges or welts similar to a pair of pliers. The grooves are designed so that the welts are supported in the grooves when the poster web is subjected to tensile stress in the transverse direction. "Welts" are elastic edge reinforcements of a flat web, for example in the form of a cord made of leather or plastic, or in the form of coil springs made of metal.

According to the French patent application, the poster web must be kept taught with transverse tension along the reinforced longitudinal edges of the poster web running in the associated grooves, so that the poster web cannot flutter even in strong winds. When the poster web is wound further to change the poster picture, the reinforced edges must slide along in the hollow grooves. This means that substantial frictional forces occur when the poster web is moved on. In particular, static friction must be overcome when the poster web starts move, and requires substantial reinforcement of the driving means, which may easily cause the poster web to slightly tear or to be destroyed.

SUMMARY OF THE INVENTION

It is therefore an object of the invention to provide a poster changer in which the web of posters, which are tensioned in the longitudinal direction, can be displayed picture-by-picture, by moving the web of posters back and forth between two winding rolls, stabilized in both the longitudinal and transverse directions. The web thus has flat stabilization, even without a protective front pane, and does not have to overcome any notable forces of friction while the web is moving, or during the start of the movement.

The invention comprises a poster holding means comprising a poster web that is movable between two rolls and which is tensioned in the transport direction. The lateral longitudinal edges of the web are reinforced. There are holding means that consist of individual guide heads arranged with a spacing from each other on each of the surfaces of the poster web. Each guide head facing a surface of the poster web is exactly opposed by a guide head on the opposite surface of the poster web, so that a pair of guide heads is formed.

The mutual spacing of the guide heads of the individual pair, and the mutual spacing of two pairs of guide heads opposing each other with respect to the width of the poster web, must be selected so that the poster web is fixed without static transverse tension, i.e., tension between the longitudinal edges without any influence of external dynamic forces such as wind. Additionally, the web must be displaceable in the longitudinal direction with very little resistance. In other words, the longitudinal edges must be stabilized as if a person were holding the poster web with both hands spread out, but in an adequately loose manner, so that the web can loosely slide between two fingers of each hand or on each side when a force is acting on the web in the longitudinal direction.

The present invention allows the poster web to be rolled in the longitudinal direction from one roll to the other with almost the same ease as with a conventional poster changer, in which the edges of the poster web are free, i.e. not stabilized in any way. The surface of the poster web is nonetheless stabilized on the edges of the web so that the web can be subjected to the action of wind and weather without the risk of any annoying fluttering.

This is accomplished by the holding means associated with the edges of the poster web, which loosely stabilize the edges of the web in several sites in the longitudinal direction of the web. At the same time, the holding means permit the web to loosely slide through in the longitudinal direction of the web. According to the invention, the longitudinal edges of the web extending from the two rolls are guided both when a picture is standing still and when the web is moving from one poster picture to the next poster picture without any active (i.e. static) transverse tension originating from the holding means. The existence of the holding means alone allows the poster web to hold on tightly to the holding means in the presence of external dynamic forces acting on it, e.g. wind forces, similar to the way in which a person holds on to a staircase railing.

According to the invention, the tips of fingers are reproduced by the guide heads. The guide head may be rounded off at least at its side facing the associated surface of the poster web, preferably with a spherical shape. Furthermore, in a way similar to a finger tip, the free end of the guide head may be provided with a bolt extending approximately perpendicular to the surface of the poster. The bolt is rotatably supported, preferably turning about its longitudinal axis extending perpendicular to the surface of the poster.

The individual guide head may be realized in the form of a roller whose axis of rotation substantially extends parallel with the surface of the poster, and preferably transverse to the direction of transport. It is particularly preferred that the individual guide head is a spherical roll that is rotatably supported, turning about any desired axes. This can take the form of a self-supported ball rolling off on the surface of the poster.

The stabilization of the poster web edge between pairs of guide heads becomes particularly effective if the poster web has an edge reinforcement. An edge reinforcement in the form of a welt can be designed in many different ways. The web needs to be thicker along its reinforced edge than in the area bordering on the reinforced edge. The thickness of the poster web at the edge reinforcement should be adequately large in relation to the area bordering on it, to an extent such that the edge reinforcement is prevented from slipping through between the guide heads within the area of the holding means. Edge reinforcements with varying thicknesses and cross sectional shapes can be used, combined with approximately the same property of smooth running.

The guide heads or pairs of guide heads can be mounted on strips extending spaced from the surface of the poster web. The guide heads, rollers or balls can be secured on the strips so that they exactly oppose each other in pairs piece by piece with respect to the two surfaces of the poster web.

The mutual spacing of the guide within a pair generally should be smaller than the thickness of the respective edge reinforcement. In particular, the spacing of the guide heads of each pair should be larger than the thickness of the poster web bordering on the edge reinforcement. Preferably, the guide heads are in the form of spherical rollers. Such spherical rollers are generally known for removing adhesive and sliding friction, for example in ball roller tracks on which heavy objects are to be displaced. Each individual ball of such a track is normally received with easy rotation in a bearing surrounding more than half of its spherical surface, e.g. supported in a ball bearing.

The holding means have pairs of guide heads between which the individual rollers of the web can pass through almost without friction. The mutual spacing of adjacent pairs of guide heads measured in the direction from the top to the bottom winding roll is to be selected adequately large or small—e.g. in the range of 5 to 20 cm—that the poster web can be laterally guided or retained and thereby stabilized across its surface even in the presence of strong winds, without any risk of throwing folds when it is further wound, or when a poster is standing still. In one embodiment, the mutual spacing of guide heads, for example spherical rollers neighboring each other one side of the web, amounted to about 10 to 15 cm. The mutual spacing of the pairs of guide heads is also dependent upon the size of the individual poster of the poster web, and on the stiffness of the material of the web.

The the individual guide heads within a pair are preferably spaced so that when a poster is changed, the web smoothly slides along the guide heads. If the poster web material is smooth (e.g. vinyl), and/or if the guide heads are rollers and preferably spherical rollers, practically no static friction occurs, and only minor negligible sliding friction.

In one embodiment, the holding means clamp the longitudinal edges in a force-locked manner between each other, preferably adjacent to any edge reinforcement, as well as when they roll off driven along the edges when being wound back and forth on the two surfaces of the poster web. The guide heads are rollers pressed against each other or against a sliding table, or belts pressed against each other or against a sliding table, and in particular, belts mounted across driven rollers. In such cases, smooth running of the web in its longitudinal direction is accomplished not through minimal friction of the guide heads but by driving the holding means.

According to another embodiment of the invention, at least one spreading means is provided as the guide head alone or as an additional means associated with the above-described holding means of each of the longitudinal edges. The spreading means consists of at least one driven helical spreader supported, for example as a shaft journal. The surface of such a helical spreader has beads diverging in the form of screw lines in the direction of the respective edge of the web. Such a spreader is rotated in such a direction and with such a speed (preferably deviating from the speed at which the poster web is transported) that the web is spread transversely to the direction of transport by the element touching the beads at the time. For example, the edge reinforcement can be eliminated in this case. The spreaders may cooperate in pairs, or for one pair of unwinding fingers rotating around their axes, in each case with a guide roll positioned between the fingers, as is known in the textile industry (See DE 25 58 162 C2). To eliminate damage to the poster web by the holding means, the spreading beads of the shaft journals or unwinding fingers, which may be cantilevered in the helical form, are in the form of brushes.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 9 shows an arrangement of two unwinding fingers with a guide roll located in between.

DETAILED DESCRIPTION OF THE PREFERRED EMBODIMENT

Figure 1:
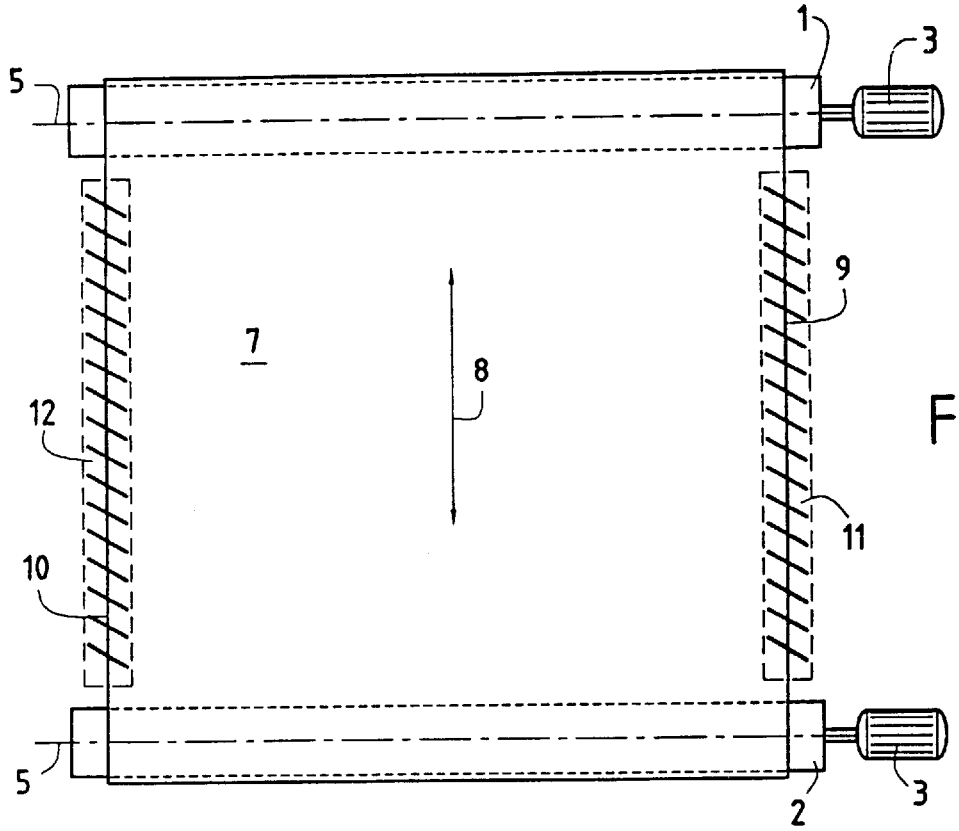
FIG. 1 is a front view of a device for suspending posters according to the invention.

The device for suspending posters according to FIG. 1 consists of two rolls 1 and 2 arranged one on top of the other, specifically an upper roll 1 and a lower roll 2, each having a driving or braking means 3, and are rotatably supported, rotating at approximately the same speed around an axle 5. A poster web 7 wound on rolls 1 and 2 therefore can be wound back and forth in a transport direction 8 with longitudinal tension. When the device is used, the winding of the web back and forth is alternately controlled so that a relatively fast movement in one direction is followed by a standstill for a preset duration of time. While the web is standing still, a defined section of the poster web with a poster is to be easily recognizable or readable by the viewer.

By adjusting the longitudinal tension in transport direction 8, a flutter-free holding of poster web 7 can be assured even with large posters sized several square meters if the suspension device is arranged in a closed showcase with a (transparent) front pane. According to the invention, however, the front pane can be omitted because longitudinal edges 9 and 10 of poster web 7 are guided by holding means 11 and 12 so that the web cannot flutter when acted upon by draft air.

Holding means 11, 12 can be designed in many different ways. In a preferred embodiment according to FIG. 2, holding means 11, 12 consist of individual guide heads 15, 16, which are arranged on the two surfaces 13, 14 of poster web 7 with a spacing from each other. Guide head 15 faces surface 13 and guide head 16 faces surface 14 of poster web 7. Each of guide heads 15, 16 has on its surface facing the respective surface 13, 14 a preferably ball-shaped rounding 17, 18. Guide heads 15, 16 are used in pairs, as a rule; however, each guide head 15 facing a poster surface 13 must be opposed by a guide head 16 on the back side or other surface 14 of the poster web for forming a pair of guide heads 19.

Figure 2:
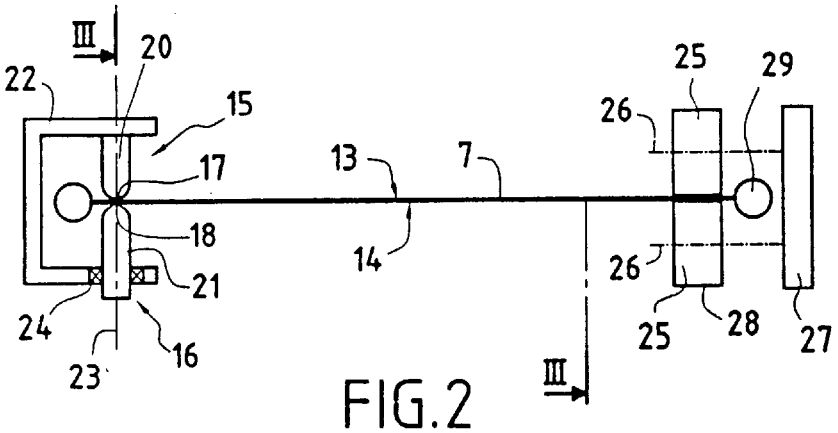
FIG. 2 is a sectional view vertically in relation to the transporting device and the plane of the poster, with a guide head associated with the edges of the poster.

In the embodiment according to FIG. 2, the individual guide head 15, 16 is located (in the left half of FIG. 2) on the free end of a bolt 20, 21, disposed about perpendicular to the surface 13, 14 of the poster web. As shown by bolt 20, the bolt may be solidly anchored fixed in a rail 22 receiving holding means 11, 12. However, as shown by bolt 21 in FIG. 2, the bolt also may be received in a ball bearing 24 provided in a rail 22, rotating around its longitudinal axis 23.

As shown in the right half of FIG. 2, a pair of wheels 25 can be provided as the holding means instead of one of the described bolts 20, 21. Wheels 25 are rotatably supported on axles 26, which are disposed parallel with the surface of poster web 7 and perpendicular to the transport direction 8. Similar to bolts 20, 21, the shaft of axles 26 can be secured on rails 27 or on some adjacent components of the housing of the poster changer.

Figure 3:
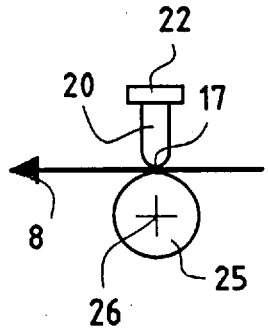
FIG. 3 is a section along line III—III of FIG. 2.

FIG. 3 shows a section along line III—III in FIG. 2 through a bolt 20 and a wheel 25. As poster web 7 is being conveyed in transport direction 8, the web slides on rounding 17 of bolt 20, or wheel 25 runs off on surface 14 of poster web 7. In the embodiment according to FIGS. 2 and 3, the mutual spacing of guide heads 15, 16, or of the rounding 17, 18 of one and same pair of guide heads 19, and the periphery 28—corresponding with the roundings—of the pair of wheels 25, is preferably selected smaller than the thickness of an edge reinforcement 29 of poster web 7. A welt as defined above, for example, can be considered as the edge reinforcement 29. At the same time, the mutual spacing of roundings 17, 18 must be adequately large, in any case in the exemplified embodiment according to FIGS. 2 and 3, so that poster web 7 can be pulled through between guide heads 15 and 16 without friction even if the guide heads are in the form of unmovable, fixed bolts 20.

Figure 4:
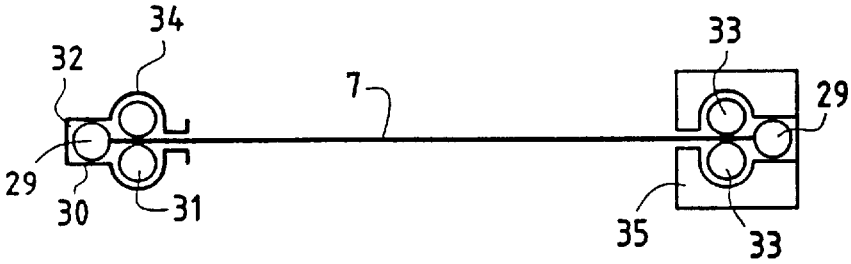
FIG. 4 is a section perpendicular to the transport direction and poster plane, with a spherical roller guidance associated with the poster edges.

In the embodiment according to FIG. 4, the guide heads of holding means 11, 12 consist of spherical rollers 31, which on both sides extend over the two web surfaces 13, 14 beyond reinforcements 29, and which are secured on spherical roller rails 30. Rails 30 themselves comprise a hollow space 32 extending through in the transport direction 8, and extending over the respective reinforcement 29 without holding or guiding it. On the inner surface of rails 30 facing the web, spherical roller pairs 33 are provided, which enclose poster web 7 between their individual balls 31. The pairs of spherical rollers just barely permit reinforcement 29 to pass through in the directions shown by arrows, permitting almost friction-free movement of web 7 in transport direction 8.

Spherical rollers 31 are received in ball bearings 34. These ball bearings and/or holding means 11 and/or 12 as a whole may be supported, in an elastic manner in buffers 35 to absorb or dampen wind gusts.

Figure 5:
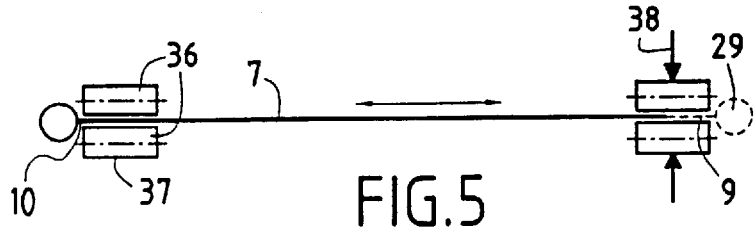
FIG. 5 is a section perpendicular to the direction of transport and the poster plane, with a pair of cylinder rollers associated with the poster edges.
Figure 6:
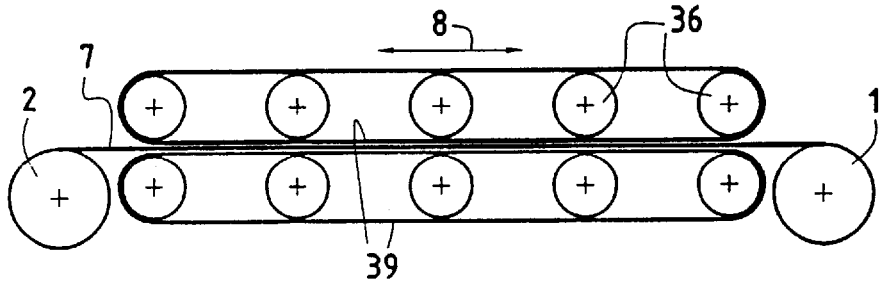
FIG. 6 is a section perpendicular to the plane of the poster and parallel with the direction of transport, with a pair of cooperating clamping belts.

According to FIG. 5, poster web 7 is guided on longitudinal edges 9, 10 via cooperating roller pairs 36. Rollers 37 of each roller pair 36 can be pressed against each other in direction 38 and thus at the same time against clamped web 7. The rollers have to run at the same speed as web 7 when driven. In order to prevent web edge 9, 10 in FIG. 5 from slipping through the respective roller pair 36, the web edge has to be equipped with a reinforcement 29 in the present case as well. In the alternative embodiment according to FIG. 6, the roller pairs are in the form of belt pairs 39 for retaining longitudinal edge 9.

Figure 7:
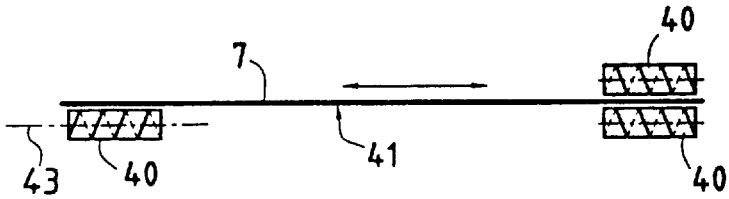
FIG. 7 is a section perpendicular to the surface of the poster and direction of transport, with spreaders associated with the edges of the poster.

Another embodiment of holding means 11 is shown in FIG. 7. In the present case, the rollers acting on the edge zones adjacent longitudinal edges 9, 10 are in the form of the helical spreaders 40. Spreaders 40 are roll journals which are preferably positioned on the back side 41 of poster web 7 facing away from the viewer. Spreaders 40 have beads 42 on their surface, which diverge in the form of a helix or screw lines. The helical spreaders 40 may be driven around their axis 43 in a direction and with a speed (preferably deviating from the transporting speed of the poster web 7) so that they retain edge zones of web 7 in the cross section of the web and prevent poster web 7 from fluttering in the presence of wind.

Figure 8:
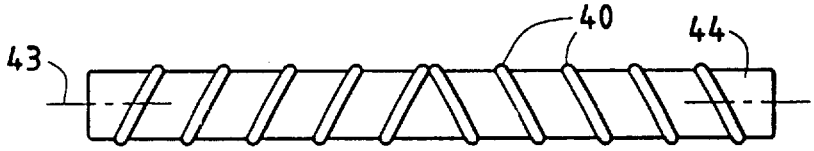
FIG. 8 shows a spreading roll.

Instead of using the short helical spreaders 40 which are associated only with the edge zones of the web, it is possible also to use spreading rolls 44 extending through in the cross direction from the one to the other longitudinal edge 9, 10 as shown in FIG. 8. Spreading rollers 44 serve as the roller guide heads as defined by the invention. Spreading rollers 44 have a calming effect on the surface of the poster web 7 and may be employed mainly when and where the poster is not be to illuminated from behind.

Figure 9:
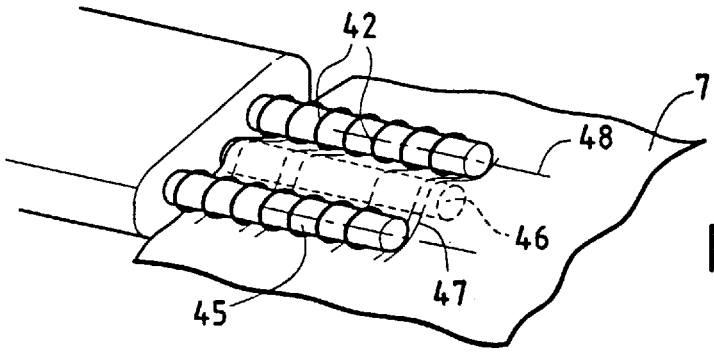

Helical spreaders 40 or spreading roll 44 according to FIGS. 7 and 8 must be in contact with poster web 7 only on one side in most cases, i.e. touch it only from the back side 41. Their effect is therefore limited. An even better stabilization of the poster surface is obtained according to FIG. 9 if the surface of web 7 is held on the edge of the web between pairs of rollers consisting of the unwinding fingers 45 set apart with a spacing and having a guide roll 46 positioned in between. On guide roll 46, web 7 forms a shaft 47. Unwinding fingers 45, which may be fitted on their surface with beads 42 diverging in the form of screw lines similar to helical spreaders 40, are preferably rotated when used, turning about their longitudinal axis 48 at a speed deviating from the speed of the web. Guide roll 46 must be pressed between the two unwinding fingers 45 to such an extent that web 7 is guided there from the tangential plane defined by the two unwinding fingers 45 and into the zone located between the fingers as the shaft 47. A certain looping angle of web 7 is obtained in this way on unwinding fingers 45, so that the effect of fingers 45 is intensified in the sense of a widely spread guidance of the web with the amplitude of the shaft 47.

Accordingly, while only a few embodiments of the present invention have been shown and described, it is obvious that many changes and modifications may be made thereunto without departing from the spirit and scope of the invention.

What is claimed is:

1. A device for suspending posters, comprising:

a poster web having two surfaces and being movable in a transport direction between two rolls arranged with a spacing one on top of the other with longitudinal tensioning in the transport direction, said poster web having lateral longitudinal edges located between said rolls and extending in the transport direction, said edges having edge reinforcements;

holding means substantially extending from roll to roll and forming lateral guides for said poster web, said holding means comprising individual guide heads arranged with a spacing from each other, wherein each guide head facing a surface of the poster web is opposed by another guide head facing an opposite poster web surface to form a pair of guide heads.

2. The device according to claim 1, wherein each individual guide head is shaped spherically on a side facing a respective surface of the poster web.

3. The device according to claim 1, wherein each one of the individual guide heads is disposed on a free end of a rotatably supported bolt, said bolt being aligned approximately perpendicular to the poster web surface and rotating around its longitudinal axis, which is aligned approximately perpendicular to the poster web surface.

4. The device according to claim 1, wherein each individual guide head comprises a roller having an axis of rotation extending substantially parallel with the poster surface and transversely to the transport direction of the web.

5. The device according to claim 1, wherein each individual guide head is rotatably supported for rotation around any desired axes and comprises a spherical roller having a ball rolling off on the surface of the poster web.

6. The device according to claim 1, wherein a mutual spacing between the guide heads of each guide head pair is smaller than the thickness of the edge reinforcements of the poster web.

7. The device according to claim 1, wherein the holding means clamp the poster web between each other adjacent to the poster web's longitudinal edges and roll off on both surfaces of the poster web as said web is wound back and forth.

8. The device according to claim 1, wherein each of the lateral longitudinal edges has at least one driven spreading means that each comprises a pair of unwinding fingers rotatable around an axis, said unwinding fingers being associated with a guide roll positioned between said fingers, wherein said fingers each have beads diverging in the form of screw lines toward the respective longitudinal edge.

9. The device according to claim 1, wherein the guide heads are elastically supported for absorbing or dampening wind gusts.

10. The device according to claim 1, wherein a mutual spacing between the guide heads of an individual guide head pair, and the mutual spacing between two pairs of guide heads opposing each other across the width of the web, the width being measured perpendicular to the transport direction of the web, is preset so that the poster web is fixed in its width without static cross tension and at the same time is displaceable in the transport direction with almost no resistance.

* * * * *